US007910277B2

(12) United States Patent
Veregin et al.

(10) Patent No.: US 7,910,277 B2
(45) Date of Patent: Mar. 22, 2011

(54) PREDICTING RELATIVE HUMIDITY SENSITIVITY OF DEVELOPER MATERIALS

(75) Inventors: Richard P. N. Veregin, Mississauga (CA); Maria N. V. McDougall, Oakville (CA); Michael S. Hawkins, Cambridge (CA); Cuong Vong, Hamilton (CA); Vladislav Skorokhod, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 832 days.

(21) Appl. No.: 11/624,004

(22) Filed: Jan. 17, 2007

(65) Prior Publication Data

US 2008/0171279 A1 Jul. 17, 2008

(51) Int. Cl.
*G03G 9/00* (2006.01)

(52) U.S. Cl. ..... 430/111.4; 430/109.3

(58) Field of Classification Search ..... 430/111.4, 430/109.3

See application file for complete search history.

(56) References Cited

U.S. PATENT DOCUMENTS

| | | | |
|---|---|---|---|
| 3,847,604 | A | 11/1974 | Hagenbach el al. |
| 4,935,326 | A | 6/1990 | Creatura et al. |
| 4,937,166 | A | 6/1990 | Creatura et al. |
| 5,290,654 | A | 3/1994 | Sacripante et al. |
| 5,308,734 | A | 5/1994 | Sacripante et al. |
| 5,370,963 | A | 12/1994 | Patel et al. |
| 5,556,727 | A | 9/1996 | Ciccarelli et al. |
| 5,593,807 | A | 1/1997 | Sacripante et al. |
| 6,153,346 | A | 11/2000 | Hideo et al. |
| 2001/0053492 | A1 | 12/2001 | Masaaki et al. |

FOREIGN PATENT DOCUMENTS

| | | |
|---|---|---|
| CA | 2 551 005 A1 | 1/2007 |

OTHER PUBLICATIONS

Canadian Office Action for Canadian Application No. 2,617,452, mailed Sep. 7, 2010.

Hamieh et al., "Study of Acid-Base Interactions Between Some Metallic Oxides and Model Organic Molecules", *Colloids and Surfaces* vol. 125, pp. 155-161, (1997).

European Search Report for European Application No. EP 08 15 0307, issued Nov. 26, 2010.

*Primary Examiner* — Mark A Chapman

(74) *Attorney, Agent, or Firm* — Oliff & Berridge, PLC

(57) ABSTRACT

A method of predicting a Lewis acid-base relative humidity (RH) ratio in a two-component developer comprised of at least a toner and a carrier including selecting a candidate toner, selecting a candidate carrier, and determining the Lewis acid and Lewis base constants for the candidate toner and candidate carrier. In addition, calculating the Lewis acid-base RH ratio wherein the calculated Lewis acid-base RH ratio is related to charge RH ratio.

19 Claims, 1 Drawing Sheet

PREDICTING RELATIVE HUMIDITY SENSITIVITY OF DEVELOPER MATERIALS

BACKGROUND

Figure 1:
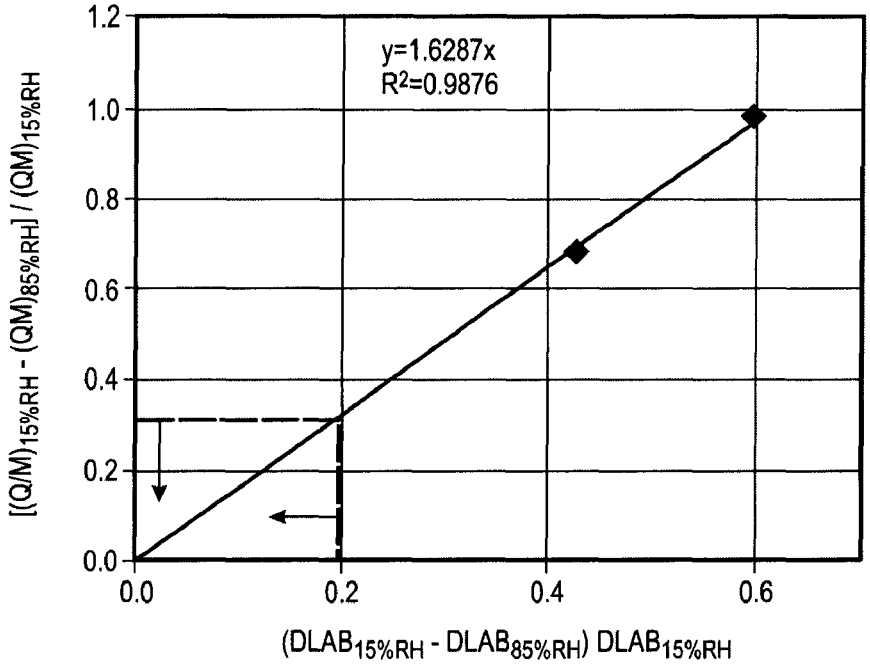

The present disclosure is related to methods of predicting relative humidity (RH) sensitivity in xerographic developer materials. In particular, the RH sensitivity of xerographic developer materials is established by calculating a Lewis acid-base RH ratio.

Humidity levels contribute to the overall print quality and performance in printing devices, such as ink jet printers, ionographic printers, laser printers, and copiers. These levels vary from model to model and, depending upon the moisture content in the media and in the air, they will directly affect print quality and performance. Some of the most frequent problems in a printing device can be caused by high RH conditions (e.g., hot, wet weather) or low RH conditions (e.g., cold, dry weather). Print quality defects common to low levels of RH can include: light or faded prints, washed-out prints, light areas of banding, and reoccurring text on the same page. Print quality defects common to high levels of RH can include: excessive background, over-saturation of color content and areas of offsetting where the toner peels off the page.

It is well known that tribo-electrification is strongly influenced by RH. For example, emulsion aggregation (EA) polyester toner particles are very hydrophilic, and thus may experience unpredictable tribo-electric charging upon exposure to atmospheric humidity. More in particular, EA polyester toners have hydrophilic functional groups on the surface of the toner, causing humidity sensitivity. At low RH, the toner tribo-electric charge may be higher in charge magnitude and at high RH the toner may be lower in charge magnitude. Such toner particles thus may need to be treated, for example with a hydrophobic agent, in order to perform over a wide range of humidity conditions.

Currently, there is no way to predict RH performance in xerographic developer materials. Improvement of charging performance with RH, that is, finding toners with desirable RH sensitivity, is largely trial and error, which is not only timely and costly, but may not produce the best results.

SUMMARY

Therefore, there is a need for a materials design procedure that accurately predicts the RH sensitivity of xerographic developer materials, for example composed of at least toner and carrier.

In embodiments, described is a two-component developer comprised of a toner and a carrier, wherein the developer has a Lewis acid-base RH ratio of less than about 0.2, and wherein the Lewis acid-base RH ratio is defined by the following equation:

$$[[\ln[(K_{at}/K_{bt})/(K_{ac}/K_{bc})]_{Low\ RH}]-[\ln[(K_{at}/K_{bt})/(K_{ac}/K_{bc})]_{High\ RH}]]/[\ln[(K_{at}/K_{bt})/(K_{ac}/K_{bc})]_{Low\ RH}].$$

Optionally, the toner may also include surface additives.

In further embodiments, described is a method of predicting a RH sensitivity in a two-component developer comprised of at least a toner and a carrier, comprising selecting a candidate toner, selecting a candidate carrier, determining a Lewis acid and a Lewis base constant for the candidate toner and candidate carrier, calculating a Lewis acid-base RH ratio, and wherein a calculated Lewis acid-base RH ratio of less than about 0.2 is predictive of acceptable RH sensitivity performance in a developer obtained from the toner and the carrier.

In still further embodiments, described is a method of making a two-component developer composed of a toner and carrier, comprising determining a Lewis acid constant for the toner, a Lewis base constant for the toner, a Lewis acid constant for the carrier, a Lewis base constant for the carrier, calculating the Lewis acid-base RH ratio by applying the following equation:

$$[[\ln[(K_{at}/K_{bt})/(K_{ac}/K_{bc})]_{15\%\ RH}]-[\ln[(K_{at}/K_{bt})/(K_{ac}/K_{bc})]_{85\%\ RH}]]/[\ln[(K_{at}/K_{bt})/(K_{ac}/K_{bc})]_{15\%\ RH}],$$

and wherein when the Lewis acid-base RH ratio is less than about 0.2, combining the toner and carrier to make the developer.

EMBODIMENTS

The present disclosure relates to predicting the sensitivity of xerographic developer materials comprised of at least a toner and carrier.

Generally, the process of electrophotographic printing includes charging a photoconductive member to a substantially uniform potential to sensitize the surface thereof. The charged portion of the photoconductive surface is exposed to a light image from a scanning laser beam, an LED source, or an original document being reproduced. This records an electrostatic latent image on the photoconductive surface. After the electrostatic latent image is recorded on the photoconductive surface, the latent image is developed. Two-component developer materials are commonly used for development. A typical two-component developer comprises carrier granules such as magnetic carrier granules, having toner particles tribo-electrically charged and adhering thereto. The toner particles are attracted to the latent image, forming a toner powder image on the photoconductive surface. The toner powder image is subsequently transferred to a copy sheet. Finally, the toner powder image is heated and/or pressed to permanently fuse it to the copy sheet in image configuration.

In electrophotographic imaging, developer compositions may comprise one or more toner compositions and one or more carrier compositions. Developers incorporating the carriers may be generated by mixing the carrier particles with toner particles, for example having a composition comprised of resin binder and colorant. Generally, from about 1 part to about 5 parts by weight of toner particles are mixed with from about 10 to about 300 parts by weight of the carrier particles. The toner concentration in the developer initially installed in a xerographic development housing may be from about 1 to about 25, such as from about 3 to about 10, parts of toner per one hundred parts of carrier.

Toner compositions that may be used in accordance with embodiments herein are not particularly limited and should be readily understood by those of skill in the art. The toner compositions typically comprise at least resin binder and colorant. Illustrative examples of suitable toner resins for use in embodiments include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, cross linked polyesters, and the like.

In embodiments, at least one binder is desired. Although any type of toner binder resin may be used, such as polyacrylates and polyesters, other resins, including copolymers of polystyrene and polybutylacrylate, may also be applicable. The binder resins may be suitably used in an EA process to form toner particles of the desired size.

Illustrative examples of resins include polymers selected from the group including but not limited to: poly(styrene-alkyl acrylate), poly(styrene-1,3-diene), poly(styrene-alkyl methacrylate), poly(styrene-alkyl acrylate-acrylic acid), poly (styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylononitrile-acrylic acid), poly(para-methyl styrene-butadiene), poly (meta-methyl styrene-butadiene), poly(alpha-methyl styrene-butadiene), poly(para-methyl styrene-isoprene), poly(meta-methyl styrene-isoprene), poly(alpha-methyl styrene-isoprene), poly(methylacrylate-styrene), poly(ethylacryalte-styrene), poly(methylmethacrylate-styrene), combinations thereof and the like.

Further illustrative examples of resins include polyethylene-terephthalate, polypropylene-terephthalate, polybutylene-terephthalate, polypentylene-terephthalate, polyhexalene-terephthalate, polyheptadene-terephthalate, polyoctalene-terephthalate. Sulfonated polyesters, such as sodio sulfonated polyesters as described in, for example, U.S. Pat. No. 5,593,807, may also be used. Additional resins, such as polyester resins, are as indicated herein and in the appropriate U.S. patents recited herein, and more specifically, examples further include copoly(1,2-propylene-dipropylene-5-sulfoisophthalate)-copoly(1,2-propylen-e-dipropylene terephthalate), copoly(1,2-propylene-diethylene-5-sulfoisophthalate)-copoly(1,2)-propylene-diethylene terephthalate), copoly(propylene-5-sulfoisophthalate)-copoly(1,2-propylene terephthalate), copoly(1,3-butylene-5-sulfoisophthalate)-copoly(1,3-butylene terephthalate), copoly(butylenesulfoisophthalate)-copoly(1,3-butylene terephthalate), combinations thereof and the like.

Vinyl monomers may include styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl-acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like. Also, there may be selected styrene butadiene copolymers, mixtures thereof, and the like.

The resin may comprise various effective amounts, such as from about 25 weight percent to about 98 weight percent, for example about 50 to about 95 weight percent, of the toner. Other effective amounts of resin can be selected.

At least one colorant including dyes, pigments, mixtures of dyes, mixtures of pigments, and mixtures of dyes and pigments, of any type may be used. Various known colorants, especially pigments, present in the toner in an effective amount of, for example, from about 1 to about 65, for example from about 2 to about 35 percent by weight of the toner or from about 1 to about 15 weight percent, that may be used include carbon black like REGAL 330™, magnetites such as Mobay magnetites MO8029™, MO8060™, and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of specific cyans that may be selected include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like. Illustrative specific examples of yellows that may be selected are Diarylide Yellow 3,3-dichlorobenzidene acetoacetanilides, a monoazo pigment identified in the Color index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected as pigments. The colorants, such as pigments, selected can be flushed pigments as indicated herein. Colorant examples further include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like.

Additional useful colorants include pigments in water based dispersions such as those commercially available from, for example, Sun Chemical include SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like or mixtures thereof. Other useful water based colorant dispersions commercially available from, for example, Clariant include HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02, which can be dispersed in water and/or surfactant prior to use.

The toner composition of embodiments can be prepared by a number of known methods, including melt blending the toner resin particles and colorant followed by mechanical attrition. Other methods include those known in the art such as spray drying, melt dispersion, emulsion aggregation, dispersion polymerization, suspension polymerization, and extrusion. Generally, the toners are prepared to have toner particles with an average volume diameter of from about 5 to about 20 microns.

The toner particles selected may be prepared from emulsion techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional. Crosslinking agents such as divinylbenzene or dimethacrylate and the like, can also be selected in the preparation of the emulsion. Chain transfer agents, such as dodecanethiol or carbontetrachloride and the like, can also be selected when preparing toner particles by emulsion polymerization.

In embodiments, the toner may include surface additives. Examples of additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved RH stability, tribo control and improved development and transfer stability.

Illustrative examples of carrier particles that may be selected for mixing with the toner particles include those particles that are capable of tribo-electrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

In embodiments, the carrier is comprised of atomized steel available commercially from, for example, Hoeganaes Corporation.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, and other known coatings and the like.

In further embodiments, the carrier core may be partially coated with a polymethyl methacrylate (PMMA) polymer having a weight average molecular weight of 300,000 to 350,000 commercially available from, for example, Soken. The PMMA is an electropositive polymer in that the polymer will generally impart a negative charge on the toner with which it is contacted.

The PMMA may optionally be copolymerized with any desired comonomer, so long as the resulting copolymer retains a suitable particle size. Suitable comonomers may include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

As mentioned above, the polymer coating of the carrier core may be comprised of PMMA, such as PMMA. PMMA may be applied in dry powder form and having an average particle size of less than 1 micrometer, such as less than 0.5 micrometers, which is applied (melted and fused) to the carrier core at higher temperatures on the order of 220° C. to 260° C. Temperatures above 260° C. may adversely degrade the PMMA. Tribo-electric tunability of the carrier and developers herein is provided by the temperature at which the carrier coating is applied, higher temperatures resulting in higher tribo up to a point beyond which increasing temperature acts to degrade the polymer coating and thus lower tribo.

The toners and developers disclosed herein may be used in xerographic devices that have a variety of process speeds. For example, such devices may have process speeds from about 170 mm/sec to about 500 mm/sec, such as from about 180 mm/sec to about 390 mm/sec or from about 190 mm/sec to about 380 mm/sec. The print speed of the xerographic devices may be from about 20 ppm to about 110 ppm, such as from about 25 ppm to about 100 ppm or from about 30 ppm to about 90 ppm. In embodiments, the print speed may be about 35 ppm, about 38 ppm, about 45 ppm, about 55 ppm, about 75 ppm or about 87 ppm.

The toner particles may be created by the emulsion aggregation (EA) process, which is illustrated in a number of patents, such as U.S. Pat. No. 5,593,807, U.S. Pat. No. 5,290,654, U.S. Pat. No. 5,308,734, and U.S. Pat. No. 5,370,963, each of which are incorporated herein by reference in their entirety.

When the colorant is added with the polymer binder particles before aggregation, the colorant may be added as a dispersion of the colorant in an appropriate medium that is, a medium compatible or miscible with the latex emulsion including the polymer particles therein. In embodiments, both the polymer binder and the colorant are in an aqueous medium.

Various optional additives may also be included in the toner composition. Such additives may include additives relating to the aggregation process, for example, surfactants to assist in the dispersion of the components or coagulants or other aggregating agents used to assist in the formation of the larger size toner particle aggregates. Such additives may also include additives for the toner core particle itself, for example, waxes, charge controlling additives, and the like.

Any other additives may also be included in the dispersion for the aggregation phase, as desired or required.

Examples of waxes that can be selected for the processes and toners illustrated herein include polypropylenes and polyethylenes commercially available from, for example, Allied Chemical and Petrolite Corporation, wax emulsions available from, for example, Michaelman Inc. and the Daniels Products Company, EPOLENE N-15™ commercially available from, for example, Eastman Chemical Products, Inc., VISCOL 550-P™, a low weight average molecular weight polypropylene available from, for example, Sanyo Kasei K. K., and similar materials. The commercially available polyethylenes selected possess, it is believed, a molecular weight $M_w$ of from about 500 to about 3,000, while the commercially available polypropylenes are believed to have a molecular weight of from about 4,000 to about 7,000. Examples of functionalized waxes include, such as amines and amides, for example, AQUA SUPERSLIP 6550™, SUPERSLIP 6530™ available from, for example, Micro Powder Inc., fluorinated waxes, such as POLYFLUO 190™, POLYFLUO 200™, POLYFLUO 523XF™, AQUA POLYFLUO 411™, AQUA POLYSILK 19™, POLYSILK 14™ available from, for example, Micro Powder Inc., mixed fluorinated amide waxes, such as MICROSPERSION 19™ available from, for example, Micro Powder Inc., imides, esters, quaternary amines, carboxylic acids or acrylic polymer emulsion, such as JONCRYL 74™, 89™, 130™, 537™, and 538™, are all available from, for example, SC Johnson Wax, chlorinated polypropylenes and polyethylenes available from, for example, Allied Chemical, Petrolite Corporation and SC Johnson Wax.

Illustrative examples of aggregating components or agents include zinc stearate; alkali earth metal or transition metal salts; alkali (II) salts, such as beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and the like. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts, such as aluminum acetate, polyaluminum chloride, aluminum halides, mixtures thereof, and the like. If present, the amount of aggregating agent selected can vary, and is, for example, from about 0.1 to about 10, and more specifically from about 1 to about 5 weight percent by weight of toner or by weight of water.

Metal oxide external surface additives are common in toners. One function of these oxides is to possibly contribute to the control of toner charging. In turn, the charge provided by the oxide is controlled by the oxide work function. Common external surface additives include, for example, silica and titania.

The mixing of the developer material generates toner charge through tribo-electrification with the carrier granules. Tribo-electrification can be strongly influenced by the environmental conditions, and specifically RH. At low RH, the toner tribo-electric charge tends to be higher in magnitude and at high RH, the toner tribo-electric tends to be lower in charge magnitude.

Low humidity conditions are frequently referred to as C-zone (approximately 10° C./15% RH), and high humidity is frequently referred to as A-zone (approximately 28° C./85% RH). In practical use, this is referring to the humidity of the environment during use of a printer. The difference in charge characteristics between the low humidity and high humidity conditions is a toner's RH sensitivity ratio. The ultimate goal is for the Lewis acid-base RH ratio of the toner to be less than about 0.2 with a charge RH ratio of less than about 0.33. When such RH ratios are achieved, the toner is equally effective in both high humidity and low humidity conditions. Said another way, the toner charge has low sensitivity to changes in RH. As used herein, "acceptable RH sensitivity performance" refers to, for example, a developer having an RH sensitivity of about 0.33 or less, for example as demonstrated by a Lewis acid-base RH ratio less than about 0.2 and a charge RH ratio of less than about 0.33.

In order to understand the chemical basis for charging, Inverse Gas Chromatography (IGC), a powerful method to study surfaces, has been used to measure Lewis acid-base parameters for developer materials. These parameters represent the ability of materials to accept or donate electrons, respectively. Using IGC, it is possible to measure a Lewis acid parameter (Ka) and a Lewis base parameter (Kb) for any solid material. Herein, it is found that the Lewis acid-base RH ratio is related to the charge RH ratio of a developer. Using IGC, it is possible to measure the Ka and Kb for any solid material. Therefore, in embodiments, the charge RH ratio of a developer can be defined as the relative loss in Q/M charge between low RH and high RH. Thus, for a developer comprised of toner and carrier components, the charge RH ratio may be described between any two RH conditions, for example between low RH and high RH, by the following equation:

$$[[Q/M]_{Low\ RH}]-[Q/M]_{High\ RH}]]/[[Q/M]_{Low\ RH}]$$

(t=toner, c=carrier)

Thus, $[[Q/M]_{Low\ RH}]$ represents both toner and carrier at low RH, that is, in the C zone. Further, $[Q/M]_{High\ RH}]$ represents both the toner and carrier at high RH, that is, in the A zone. Therefore, combining the two provides an equation that describes the charging ratio between the two RH conditions that is, low RH or C zone, and high RH or A zone.

Because Q/M depends on the developer Lewis acid-base values, the RH sensitivity of the developer Lewis acid-base ratio values for the developer between low RH and high RH, for example between 15% and 85%, may also be defined as:

$$[[\ln[(K_{at}/K_{bt})/(K_{ac}K_{bc})]_{Low\ RH}]-[\ln[(_{Low\ RH}]K_{at}K_{bt})/(K_{ac}/K_{bc})]_{High\ RH}]]/[\ln[(K_{at}/K_{bt})/(K_{ac}/K_{bc})]$$

(t=toner, c=carrier)

The result is that the RH sensitivity of the developer depends on the RH sensitivity of the developer Lewis acid-base ratio values, as shown in Table 1 (below). However, this relationship may only apply if Q/A at low RH and high RH are either both a negative charge or a positive charge. As the developer Lewis acid-base RH sensitivity increases from zero, the Q/M RH sensitivity also increases from zero. From a linear least squares fit in Table 1 (below), the relationship is:

$$[[Q/M]_{Low\ RH}]-[Q/M]_{High\ RH}]]/[[Q/M]_{Low\ RH}]=1.63\times[[\ln[(K_{at}/K_{bt})/(K_{ac}/K_{bc})]_{Low\ RH}]-[\ln[(K_{at}/K_{bt})/(K_{ac}/K_{bc})]_{High\ RH}]]/[\ln[(K_{at}/K_{bt})/(K_{ac}/K_{bc})]_{Low\ RH}]$$

This relationship demonstrates that for a developer to have a good RH sensitivity, the charge RH ratio should be, for example less than about 0.33, and the developer Lewis acid-base RH ratio should be, for example less than about 0.2. Thus, if the developer Lewis acid-base values of the materials are controlled so that the developer charge RH ratio is less than about 0.33 and the Lewis acid-base RH ratio is less than about 0.2, then the developer will have good RH sensitivity.

The predictive model in FIG. 1 can be used to save time and money in developing developers with excellent RH sensitivity. Mainly, there is no need to make toners and carriers and then evaluate the RH performance. This method allows one to accurately predict RH performance by simply obtaining the $K_a$ and $K_b$ values with a simple measurement. Thus, once the Lewis acid and base constants are measured, an RH sensitivity can be predicted for any combination of toner and carrier materials that have been measured. If the RH sensitivity is within the desired performance, a developer can be made by combining the toner and carrier, for example, by mixing.

In embodiments, once an acceptable Lewis acid-base RH is found, the toner and carrier may be combined to make the developer.

COMPARATIVE EXAMPLE AND EXAMPLE

A measured toner $K_{at}/K_{bt}$ is 0.94 at 15% RH and a measured, carrier $K_{ac}/K_{bc}$ is 0.44 at 15% RH. At 85% RH, the measured toner $K_{at}/K_{bt}$ is 1.16 and the measured carrier $K_{ac}/K_{bc}$ is 0.75. Inserting these numbers into the Lewis acid-base RH ratio returned a value of 0.4. For this developer, the charge at 15% RH is −5.2, and at 85% RH the charge is −1.7. Inserting these numbers into the charge RH ratio returned a value of 0.7. However, the Lewis-acid base RH ratio does not meet the requirement to be less than about 0.2, and the charge RH ratio does not meet the requirement to be less than about 0.33. Thus, the predictive model in FIG. 1 is not applicable. In general, if triboelectric charge is less than 15 μC/g, the background on a print will be unacceptable. Further, loose toner can also be emitted from the developer producing a toner cloud or aerosol that results in contamination of other parts of the xerographic printer.

In order to meet negative charge requirements of greater than 15 μC/g at both low RH and high RH, it is necessary that the toner components acid value be increased and/or toner base value be increased, and/or the carrier acid value be decreased, and/or the carrier base value be increased. Some illustrative examples of suitable toner materials with higher acid and low base values are polytetrafluoroethylene, with a $K_a/K_b$ value of 3, polyvinylchloride with a $K_a/K_b$ value of 4, or glass fibers with a $K_a/K_b$ value of 4. Examples of suitable carrier materials with low acid value are $CaCO_3$, with a $K_a/K_b$ value of 0.25 and polystryrene, with a $K_a/K_b$ value of 0.27. In order to meet the charge requirement, one or more of these components may be added in the appropriate developer component so that the overall $K_a/K_b$ value is greater than the overall $K_a/K_b$ of the carrier materials. The larger the difference, the larger the negative charge.

In order to provide low RH sensitivity, it is necessary that the toner acid value, compared to the base value, remain constant with increasing RH, or alternatively increases with RH. This will keep the $K_a/K_b$ value high at high RH. It is also necessary to keep the carrier acid value low relative to the base value, or decreasing with RH, so that the carrier $K_a/K_b$ value remains constant or decreases. Maintaining a large difference between the toner and carrier $K_a/K_b$ values is required to maintain high charge under all environmental conditions. To maintain constant $K_a/K_b$, it is necessary that water adsorption be minimized, as water has a measured $K_a/K_b$ of 1.2, thus adsorption of water will tend to decrease the $K_a/K_b$ of the toner materials which have desirably higher $K_a/K_b$, and increase the $K_a/K_b$ of carrier materials that have desirably lower $K_a/K_b$ values. For example, the requirement for low water adsorption is met by hydrophobic materials like polystyrene and polytetrafluroethylene.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A two-component developer comprised of a toner and a carrier, wherein the developer has a Lewis acid-base relative humidity (RH) ratio less than about 0.2, and wherein the Lewis acid-base RH ratio is defined by the following equation:

$$[[\ln[(K_{at}/K_{bt})/(K_{ac}/K_{bc})]_{Low\ RH}]-[\ln[(K_{at}/K_{bt})/(K_{ac}/K_{bc})]_{High\ RH}]]/[\ln[(K_{at}/K_{bt})/(K_{ac}/K_{bc})]_{Low\ RH}],$$

$K_{at}$ being the Lewis acid constant for the toner, $K_{bt}$ being the Lewis base constant for the toner, $K_{ac}$ being the Lewis acid constant for the carrier, and $K_{bc}$ being the Lewis base constant for the carrier.

2. The developer of claim 1, wherein the Low RH is 15% and the High RH is 85%.

3. The developer of claim 1, wherein the developer has a Lewis acid-base RH ratio less than about 0.2 and a charge RH ratio of less than about 0.33.

4. The developer of claim 3, wherein at least one or more toner surface additives provide a Lewis acid-base RH ratio that is less than about 0.2 and a charge RH ratio of less than about 0.33.

5. The developer of claim 4, wherein at least one of the one or more toner surface additives is a metal oxide.

6. The developer of claim 1, wherein the toner is an emulsion aggregation (EA) toner.

7. The developer of claim 6, wherein a binder of the toner is selected from a group consisting of polyesters and polyacrylates.

8. The developer of claim 6, wherein a binder of the toner is a copolymer of polystyrene and polybutylacrylate.

9. The developer of claim 1, wherein a colorant is a pigment, a dye, a mixture of pigments, a mixture of dyes, or a combination thereof.

10. The developer of claim 1, wherein the carrier is selected from a group consisting of granular zircon, granular silicon, glass, steel, nickel, ferrites, iron ferrites, and silicon dioxide.

11. A method of predicting acceptable RH sensitivity performance in a two-component developer comprised of at least a toner and a carrier comprising:

selecting a candidate toner;

selecting a candidate carrier;

determining Lewis acid and Lewis base constants for the candidate toner and for the candidate carrier;

calculating a Lewis acid-base RH ratio having the following equation $$[[\ln[(K_{at}/K_{bt})/(K_{ac}/K_{bc})]_{15\%\ RH}]-[\ln[(K_{at}/K_{bt})/(K_{ac}/K_{bc})]_{85\%\ RH}]]/\ln[(K_{at}/K_{bt})/(K_{ac}/K_{bc})]_{15\%\ RH}]$$

$K_{at}$ being the Lewis acid constant for the toner, $K_{bt}$ being the Lewis base constant for the toner, $K_{ac}$ being the Lewis acid constant for the carrier, and $K_{bc}$ being the Lewis base constant for the carrier; and wherein the calculated Lewis acid-base RH ratio of less than about 0.2 is predictive of acceptable RH sensitivity performance in a developer obtained from the toner and the carrier.

12. The method of claim 11, wherein the Lewis acid and the Lewis base constants equal $K_a$ and $K_b$ at the High RH and the Low RH.

13. The method of claim 11, wherein the two-component developer comprises a toner, a carrier, and one or more surface additives of the toner.

14. The method of claim 11, wherein the toner is generated by an emulsion aggregation process.

15. A method of making a two-component developer composed of at least a toner and a carrier, comprising:

determining a Lewis acid constant for the toner, a Lewis base constant for the toner, a Lewis acid constant for the carrier, and a Lewis base constant for the carrier;

calculating the Lewis acid-base RH ratio by applying the following equation:

$$[[\ln[(K_{at}/K_{bt})/(K_{ac}/K_{bc})]_{15\%\,RH}]-[\ln[(K_{at}/K_{bt})/(K_{ac}/K_{bc})]_{85\%\,RH}]]/\ln[(K_{at}/K_{bt})/(K_{ac}/K_{bc})]_{15\%\,RH}]$$

$K_{at}$ being the Lewis acid constant for the toner, $K_{bt}$ being the Lewis base constant for the toner, $K_{ac}$ being the Lewis acid constant for the carrier, and $K_{bc}$ being the Lewis base constant for the carrier; and wherein when the Lewis acid-base RH ratio is less than about 0.2, combining the toner and the carrier to make the developer.

16. The method of claim 15, wherein the toner is an emulsion aggregation (EA) toner.

17. The method of claim 15, wherein a binder of the toner is selected from a group consisting of polyesters and polyacrylates.

18. The method of claim 15, wherein the developer has a Lewis acid-base RH ratio that is less than about 0.2 and a charge RH ratio of less than about 0.33.

19. The method of claim 15, wherein a colorant is a pigment, a dye, a mixture of pigments, a mixture of dyes, or a combination thereof.

* * * * *